US005311154A

United States Patent [19]

Hirota

[11] Patent Number: 5,311,154

[45] Date of Patent: May 10, 1994

[54] WAVEGUIDE CONVERTER FOR TRANSMITTING INPUT RADIO WAVE WITH PROCEEDING DIRECTION THEREOF CHANGED TO WAVEGUIDE PATH

[75] Inventor: Makoto Hirota, Kobe, Japan

[73] Assignee: Sharp Kabushiki Kaisha, Osaka, Japan

[21] Appl. No.: 950,704

[22] Filed: Sep. 25, 1992

[30] Foreign Application Priority Data

Sep. 27, 1991 [JP] Japan ..... 3-276983

[51] Int. Cl.[5] ..... H01P 5/107

[52] U.S. Cl. ..... 333/26; 333/249

[58] Field of Search ..... 333/26, 249

[56] References Cited

U.S. PATENT DOCUMENTS 2,829,348 4/1958 Kostriza et al. ..... 333/26

4,550,296 10/1985 Ehrlinger et al. ..... 333/26

FOREIGN PATENT DOCUMENTS 62-207003 9/1987 Japan .

*Primary Examiner*—Paul Gensler

[57] ABSTRACT

A bend portion is provided on the inside of a waveguide main body for bending a proceeding direction of a radio wave from a waveguide on the side of a primary feed horn. The radio wave is transmitted with its proceeding direction changed such that an electric field of the radio wave is parallel with a conversion unit. Further provided on the inside of the waveguide main body is a conversion unit including a microstrip line for converting the radio wave from the bend portion to supply electric power.

11 Claims, 2 Drawing Sheets

WAVEGUIDE CONVERTER FOR TRANSMITTING INPUT RADIO WAVE WITH PROCEEDING DIRECTION THEREOF CHANGED TO WAVEGUIDE PATH

BACKGROUND OF THE INVENTION

1. Field of the Invention

The present invention relates generally to waveguide converters, and more particularly, to a structure of a waveguide input unit of a satellite communication/satellite broadcasting receiving outdoor converter (also referred to as "LNB" hereinafter) mounted on an outdoor antenna for receiving satellite broadcasting.

2. Description of the Background Art

In general, a waveguide inlet of a LNB is provided between a waveguide on the side of a primary feed horn of a BS antenna and a main body of the waveguide of the LNB for receiving a radio wave of a predetermined band. The waveguide on the side of the primary feed horn constitutes an output side of the BS antenna (a parabola antenna etc.), while a probe connected to a microstrip line is provided in the waveguide main body of the LNB.

FIG. 4 is a sectional view showing a structure of an inlet of a conventional LNB waveguide. In this conventional example, a probe 3 is provided so as to jut out of a hole 2 provided at an inner side surface of a hole 4 of a waveguide main body 1 into the hole 4. The probe 3 is coupled to a strip conductor (not shown) of a microstrip line 20 through a junction portion 5. Then, a radio wave in the waveguide main body 1 is transmitted through the probe 3.

With the structure of the conventional example shown in FIG. 4, however, the portion 5 at which the microstrip line 20 and the probe 3 are coupled to each other generates a signal loss. This is because the probe 3 structured of a conductor of brass etc. surrounded by resin such as Teflon, causes variations of elements in size, variations in diameter of holes of the microstrip line 20 to which the probe 3 is attached and the amount of soldering for fixing the junction portion 5, resulting in generation of a signal loss. The signal loss adversely affects a noise figure (in general, a target noise figure is on the order of 1.0 dB, which is reduced by 0.03–0.07 dB due to said signal loss). Therefore, signal loss should be often compensated for and adjusted by the strip conductor on the microstrip line 20. This increases operation loss.

In addition, the necessity of providing the hole 2 with a precise diameter size and fine-finished surface at the side of the hole 4 of the waveguide main body 1 along with the necessity of an expensive probe make the LNB waveguide inlet inapplicable to mass production and unprofitable.

SUMMARY OF THE INVENTION

An object of the present invention is to reduce a signal loss in a conversion unit of a waveguide converter.

Another object of the present invention is to reduce manufacturing costs of a waveguide converter.

A further object of the present invention is to increase a yield in production of waveguide converters.

In order to achieve the above-described objects, a waveguide converter according to the present invention is characterized in that a waveguide converter for transmitting a radio wave input through a waveguide converter at the side of a primary feed horn to a microstrip line, is provided with a bend portion for changing a proceeding direction of the input radio wave and transmitting the radio wave with its proceeding direction changed to the microstrip line.

Since the waveguide converter structured as described above changes a proceeding direction of an input radio wave and transmits the radio wave having its proceeding direction changed to a microstrip line, the converter decreases a signal loss at a conversion unit without requiring an expensive probe.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The foregoing and other objects, features, aspects and advantages of the present invention will become more apparent from the following detailed description of the present invention when taken in conjunction with the accompanying drawings, which are given by way of illustration only and thus are not limitative of the present invention, and wherein.

DESCRIPTION OF THE PREFERRED EMBODIMENTS

An embodiment of the present invention will be described in the following with reference to the drawings.

Figure 1:
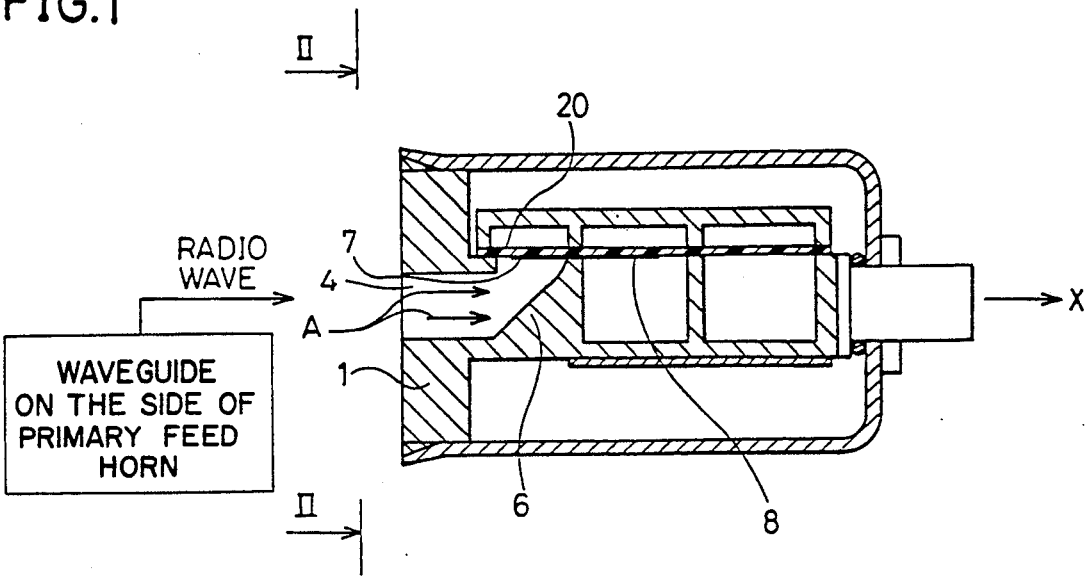
FIG. 1 is a schematic sectional view showing a structure of a main part of a waveguide converter according to one embodiment of the present invention.
Figure 2:
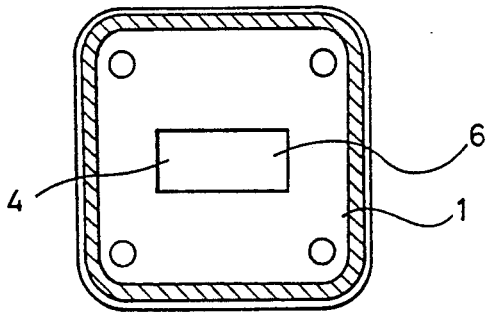
FIG. 2 is a view seen from II—II line of FIG. 1.

FIG. 1 schematically shows a section of a structure of a main part of a waveguide inlet of a LNB according to one embodiment of the present invention. FIG. 2 is a view seen from II—II line of FIG. 1.

As shown in FIGS. 1 and 2, the waveguide converter of the present embodiment is structured such that a waveguide main body 1 to be coupled to a waveguide 11 on the side of a primary feed horn includes a bend portion 6 for bending the proceeding direction of a radio wave from the waveguide of the primary feed horn and transmitting the radio wave having its proceeding direction changed. Furthermore, the waveguide main body includes conversion unit 7 comprised of a microstrip line 20 for converting the radio wave from the bend portion 6 to supply an electric power.

As described above, in the present embodiment, the bend portion 6 for transmitting an electric field in the waveguide is provided deep in the hole 4 of the waveguide main body 1. The bend portion 6 transmits a radio wave to the conversion unit 7 located in parallel with the radio wave proceeding direction A (arrows of FIG. 1). The radio wave proceeding direction A and the direction of the installation of the conversion unit 7 are in parallel with an axis direction X of the waveguide converter. That is, the present embodiment can improve a radio wave conversion efficiency because the waveguide of the present embodiment bends a proceeding direction of a radio wave from the waveguide 11 of the primary feed horn such that an electric field of the radio wave is in parallel with the conversion unit 7.

Figure 3:
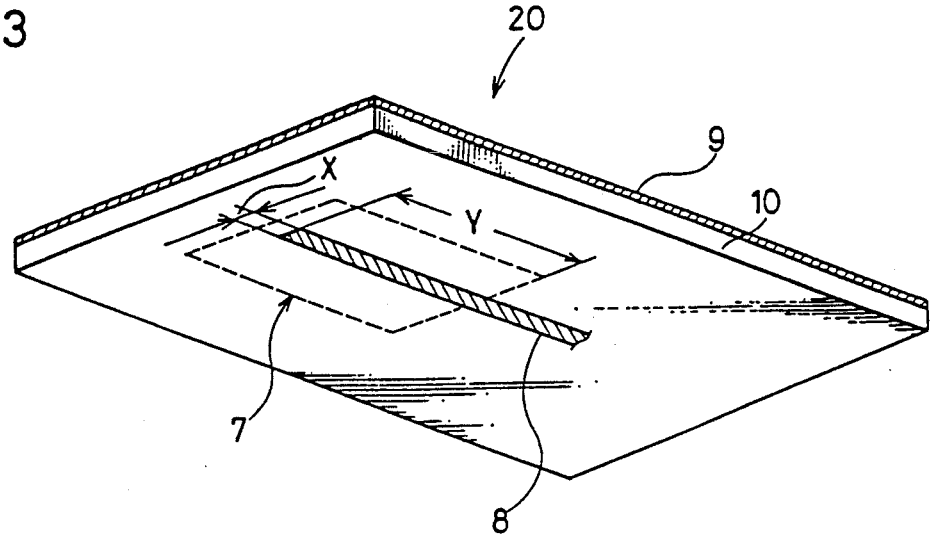
FIG. 3 is a perspective view showing a specific structure of a microstrip line shown in FIG. 1.
Figure 4:
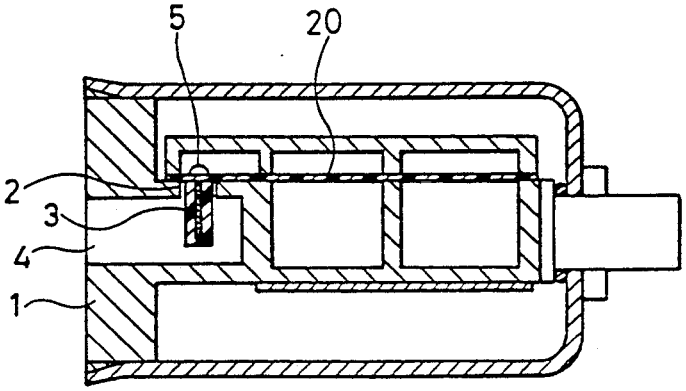
FIG. 4 PRIOR ART
FIG. 4 is a schematic sectional view showing a structure of a main part of a conventional waveguide converter.

FIG. 3 schematically shows the microstrip line 20 constituting the conversion unit 7, with a part of the microstrip line omitted for convenience. As shown in the figure, the microstrip line 20 mainly includes a dielectric 10, a conductor 9 for grounding provided on one side of the dielectric and a strip conductor 8 provided on the other side thereof. A part of the strip conductor 8 serves as the conversion unit 7. The strip conductor part of the microstrip line 20 other than the part of the conversion unit 7, is provided with a conductor pattern and elements such as transistors as in the conventional example and the strip conductor part serves as a unit for transmitting a converted signal. Then, the strip conductor part other than the portion of the conversion unit 7 is directly connected to the strip conductor 8 of the conversion unit 7 on the microstrip line 20. The size of the strip conductor in the conversion unit 7 according to the present embodiment is 1.95 mm for X and 6.45 mm for Y.

Such structure of the present embodiment does not require the probe 3 and involves no loss in conversion through a probe or in coupling the microstrip line 20, so that it is possible to avoid deterioration of important performances by using a low noise converter. In addition, there is no need of soldering the probe 3 with the microstrip line 20, adjusting the microstrip line 20 and processing a precise hole for a probe of the waveguide main body, whereby mass production of the waveguide converters is enhanced.

Furthermore, by dispensing of the need of processing a hole of a waveguide main body, a reduction of material costs is realized. Since there is no need of the probe 3 and other processes a large reduction of material costs are further realized and processing costs to significantly improve profitability.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A waveguide converter for transmitting a radio wave input through a waveguide of a primary feed horn to a microstrip line, comprising changing means for changing a proceeding direction of the input radio wave and coupling the input radio wave with its proceeding direction changed to said microstrip line, said changing means changing the direction of the input radio wave so that the direction of the electric field of the input radio wave is parallel with the direction of said microstrip line.

2. The waveguide converter according to claim 1, wherein the input radio wave is transmitted in parallel with an axis direction of the waveguide converter and said microstrip line is arranged in parallel with the axis direction of the waveguide converter.

3. The waveguide converter according to claim 1, wherein said changing means includes a first opening formed in a main body of the waveguide for receiving the input radio wave and a second opening connected to said first opening, an inner portion of said second opening being bent toward the surface of said microstrip line.

4. A waveguide inlet having a waveguide main body coupled to a waveguide of a primary feed horn comprising:

a bend portion formed in the waveguide main body for bending a proceeding direction of a radio wave input from the waveguide of the primary feed horn and for transmitting the radio wave in a changed proceeding direction; and conversion means having a microstrip line for converting the radio wave transmitted from said bend portion to supply electric power, said bend portion bending the radio wave so that the direction of the electric field of the radio wave is parallel with said conversion means.

5. The waveguide inlet according to claim 4, wherein said microstrip line includes a plate-like dielectric, a conductor for grounding formed on an entire surface of a first side of said dielectric and a strip conductor formed on a part of a second side of said dielectric.

6. The waveguide inlet according to claim 5, wherein a part of said strip conductor on said second side forms said conversion means and receives the radio wave from said bend portion.

7. A waveguide converter for coupling an input radio wave of a waveguide to a microstrip line comprising:

an inlet port, formed within a main body of the waveguide, for receiving the input radio wave, the microstrip line being mounted within the main body of the waveguide in a direction parallel to the direction of the input radio wave; and changing means for changing the direction of the input radio wave to couple the input radio wave to the microstrip line, said changing means being formed as a sloped inner portion of the main body of the waveguide.

8. The waveguide converter of claim 7, wherein said changing means changes the direction of the input radio wave so that the direction of the electric field of the input radio wave is parallel with said microstrip line.

9. The waveguide converter of claim 7, wherein said inlet port is rectangular shaped, said changing means having a first opening abutting said inlet port within the main body of the waveguide wherein said sloped inner portion slopes in an upward direction from said first opening to a second opening, said microstrip line being mounted within the main body of the waveguide adjacent said second opening.

10. A method of coupling a radio wave to a microstrip line comprising the steps of:

inputting the radio wave into an inlet port of a waveguide; and changing the direction of the input radio wave to couple the radio wave to the microstrip line which is mounted within a main body of the waveguide, said step of changing the direction comprising guiding the input radio wave along a sloped inner portion of the main body of the waveguide.

11. The method of coupling a radio wave to as microstrip line of claim 10, wherein during said step of changing the direction, the direction of the electric field of the input radio wave is changed to be parallel with the direction of the microstrip line.

* * * * *